US008146580B2

(12) United States Patent
Wei

(10) Patent No.: US 8,146,580 B2
(45) Date of Patent: Apr. 3, 2012

(54) STRUCTURE FOR OPENING GRIP COVER OF TOY GUN

(76) Inventor: Ho-Sheng Wei, Taipei Hsien (TW)

( * ) Notice: Subject to any disclaimer, the term of this patent is extended or adjusted under 35 U.S.C. 154(b) by 379 days.

(21) Appl. No.: 12/630,134

(22) Filed: Dec. 3, 2009

(65) Prior Publication Data

US 2011/0131882 A1 Jun. 9, 2011

(51) Int. Cl.
*F41B 11/00* (2006.01)

(52) U.S. Cl. ..... 124/74

(58) Field of Classification Search ..... 124/74, 124/1; 42/71.02

See application file for complete search history.

(56) References Cited

U.S. PATENT DOCUMENTS

| | | | | |
|---|---|---|---|---|
| 3,127,885 | A * | 4/1964 | Kline et al. | 124/74 |
| 4,344,410 | A * | 8/1982 | Curran | 124/80 |
| 5,711,286 | A * | 1/1998 | Petrosyan et al. | 124/73 |
| 6,029,645 | A * | 2/2000 | Wonisch et al. | 124/74 |
| 6,494,194 | B2 * | 12/2002 | Shipachev et al. | 124/73 |
| 6,869,285 | B1 * | 3/2005 | Jones, II | 434/16 |
| 7,290,539 | B2 * | 11/2007 | Maeda et al. | 124/74 |
| 7,603,996 | B2 * | 10/2009 | Wei | 124/74 |
| 2006/0096147 | A1 * | 5/2006 | Gussalli Beretta | 42/71.02 |
| 2007/0181116 | A1 * | 8/2007 | Wei | 124/74 |

* cited by examiner

*Primary Examiner* — Troy Chambers

(74) *Attorney, Agent, or Firm* — Chun-Ming Shih; HDLS IPR Services

(57) ABSTRACT

A structure for opening a grip cover of a toy gun includes a bottom cover assembly and a rear cover assembly. The bottom cover assembly has a bottom cover covering a bottom surface of the grip and a pivot penetrating the grip and the bottom cover. One end of the bottom cover adjacent to the pivot is formed with a first hook. The rear cover assembly has a rear cover covering a rear surface of the grip. The rear cover has a protrusion connected to the grip. One end of the rear cover away from the protrusion is formed with a second hook to be engaged with the first hook. With this structure, the first hook is separated from the second hook when the bottom cover rotates downwards, thereby driving the rear cover to open rearwards by using the protrusion as a center of rotation. In this way, by only opening the bottom cover, the user can open the rear cover assembly simultaneously, thereby exchanging a pressurized gas cylinder in the grip more rapidly. Further, the problem that members may get lost or suffer damage can be prevented.

18 Claims, 7 Drawing Sheets

STRUCTURE FOR OPENING GRIP COVER OF TOY GUN

BACKGROUND OF THE INVENTION

1. Field of the Invention

The present invention relates to a toy gun, and in particular to a structure for opening a grip cover of a toy gun.

2. Description of Prior Art

Due to many people pay more attention to the quality of their life, shooting BB bullets or paint bullets has become one kind of field activities for training shooters or a team competition. Such a BB-bullet (or paint-bullet) toy gun is powered by gas, in which a pressurized gas cylinder is inserted into the grip of the toy gun. In this way, the high-pressure gas in the gas cylinder will pass through a valve and a gas-delivering pipe and enter a barrel of the toy gun. By means of the high-pressure gas, the percussion of bullets can be achieved. During the operation of this gas-powered toy gun, the user has to exchange magazines and the gas cylinders. If the high-pressure gas is exhausted in the gas cylinder, the toy gun will lose its power for shooting bullets.

Thus, the manufacturers in this art propose combining the pressurized gas cylinder with the magazine. By this structure, when the user exchanges the magazine, the bullets and the pressurized gas cylinder can be supplemented at the same time. However, in practice, the bullets and the high-pressure gas are not always exhausted simultaneously. Thus, such a design may waste the bullets and high-pressure gas.

In view of this, the manufacturers propose separating the magazine from the pressurized gas cylinder. In general, the action of exchanging the pressurized gas cylinder involves the following steps. First, the user has to remove a protective cover from the grip to show the pressurized gas cylinder within the grip. Then, the user loosens a screw adjuster in the bottom of the grip, whereby the pressurized gas cylinder can be lowered and the user can take the gas cylinder out of the grip. After the user installs a new pressurized gas cylinder in the grip and tightens the screw adjuster, the pressurized gas cylinder is lifted to connect to the valve. Finally, the protective cover is mounted on the grip again. Until this moment, the user can continue to shoot bullets. Thus, according to above, the action of exchanging the pressurized gas cylinder involves several steps, which really takes a lot of time. Further, it is necessary for the user to loosen or tighten the screw adjuster when exchanging the gas cylinder. Thus, the location for taking the gas cylinder in or out of the grip is much related to the location of the screw adjuster. On the other hand, when the protective cover is removed from the grip, it becomes a separate member. As a result, the user has to take care of the removed protective cover. At the same time, the user has to grip the barrel with one hand and loosen the screw adjuster with another hand, thereby exchanging the gas cylinder. Therefore, it is apparent that the user will be in a great bustle. Even, the protective cover may be lost and suffer damage. Especially, when two parties are "fighting" against each other, the players must seize every minute and second. However, the players almost cannot fight back when they are exchanging the gas cylinder. Thus, not only the user has to be familiar with the action of exchanging the gas cylinder, but also the manufacturer continues to develop a novel toy gun capable of exchanging the gas cylinder rapidly.

Therefore, it is an important issue for the present Inventor to solve above-mentioned problems.

SUMMARY OF THE INVENTION

The present invention is to provide a structure for opening a grip cover of a toy gun. The user only needs to open a bottom cover of the grip, and a rear cover of the grip can be driven to open simultaneously. In this way, the gas cylinder can be exchanged rapidly.

The present invention is to provide a structure for opening a grip cover of a toy gun, which includes: a bottom cover assembly comprising a bottom cover covering a bottom surface of the grip and a pivot penetrating the grip and the bottom cover, the bottom cover being rotatable outwards with respect to the bottom surface of the grip, one end of the bottom cover adjacent to the pivot being formed with a first hook; and a rear cover assembly having a rear cover covering a rear surface of the grip, the rear cover having a protrusion connected to the grip, the rear cover being rotatable outwards with respect to the rear surface of the grip, one end of the rear cover away from the protrusion being formed with a second hook to be engaged with the first hook, wherein the first hook is separated from the second hook when the bottom cover rotates downwards, thereby driving the rear cover to open rearwards by using the protrusion as a center of rotation.

The present invention is to provide a structure for opening a grip cover of a toy gun, which includes: a bottom cover assembly comprising a bottom cover covering a bottom surface of the grip and a pivot penetrating the grip and the bottom cover, one end of the bottom cover adjacent to the pivot being formed with a first hook; and a rear cover assembly having a rear cover covering a rear surface of the grip, the rear cover having a protrusion connected to the grip, one end of the rear cover away from the protrusion being formed with a second hook to be engaged with the first hook, wherein the first hook is separated from the second hook when the bottom cover rotates downwards, thereby driving the rear cover to open rearwards by using the protrusion as a center of rotation.

In comparison with prior art, the present invention has advantageous features as follows.

When the bottom cover rotates downwards, the first hook can be removed from the second hook, thereby driving the rear cover to open rearwards by using the protrusion as a center of rotation. Thus, by only opening the bottom cover downwards, the user can simultaneously open the rear cover assembly to show a pressurized gas cylinder within the grip. In this way, the user can exchange the gas cylinder easily and rapidly, so that the time for exchanging the gas cylinder can be reduced.

In consideration of the fact that the screw adjuster has to be loosened before the gas cylinder is taken out of the grip, and the screw adjuster has to be tightened after a new gas cylinder is disposed in the grip, according to the present invention, the screw adjuster in the bottom of the grip can be shown when the bottom cover is opened, and the gas cylinder can be shown when the rear cover is opened. Thus, according to the present invention, the user can open the bottom cover easily to drive the rear cover assembly to open simultaneously. Then, the user loosens the screw adjuster to take out of the exhausted gas cylinder, and installs a new gas cylinder into the grip. Then, the user tightens the screw adjuster and closes the bottom cover. Finally, the rear cover assembly is closed on the rear surface of the grip until the second hook is engaged with the first hook. Therefore, it is apparent that the structure of the present invention can facilitate the operation of the user.

Further, since the bottom cover assembly and the rear cover assembly are pivotally connected to the grip respectively, they will not be detached from the grip to become two separate members. Thus, when exchanging the gas cylinder, the user needs not to worry that these two members may get lost or suffer damage.

DETAILED DESCRIPTION OF THE INVENTION

The characteristics and technical contents of the present invention will be explained with reference to accompanying drawings. However, the drawings are illustrative only but not used to limit the present invention.

Figure 1:
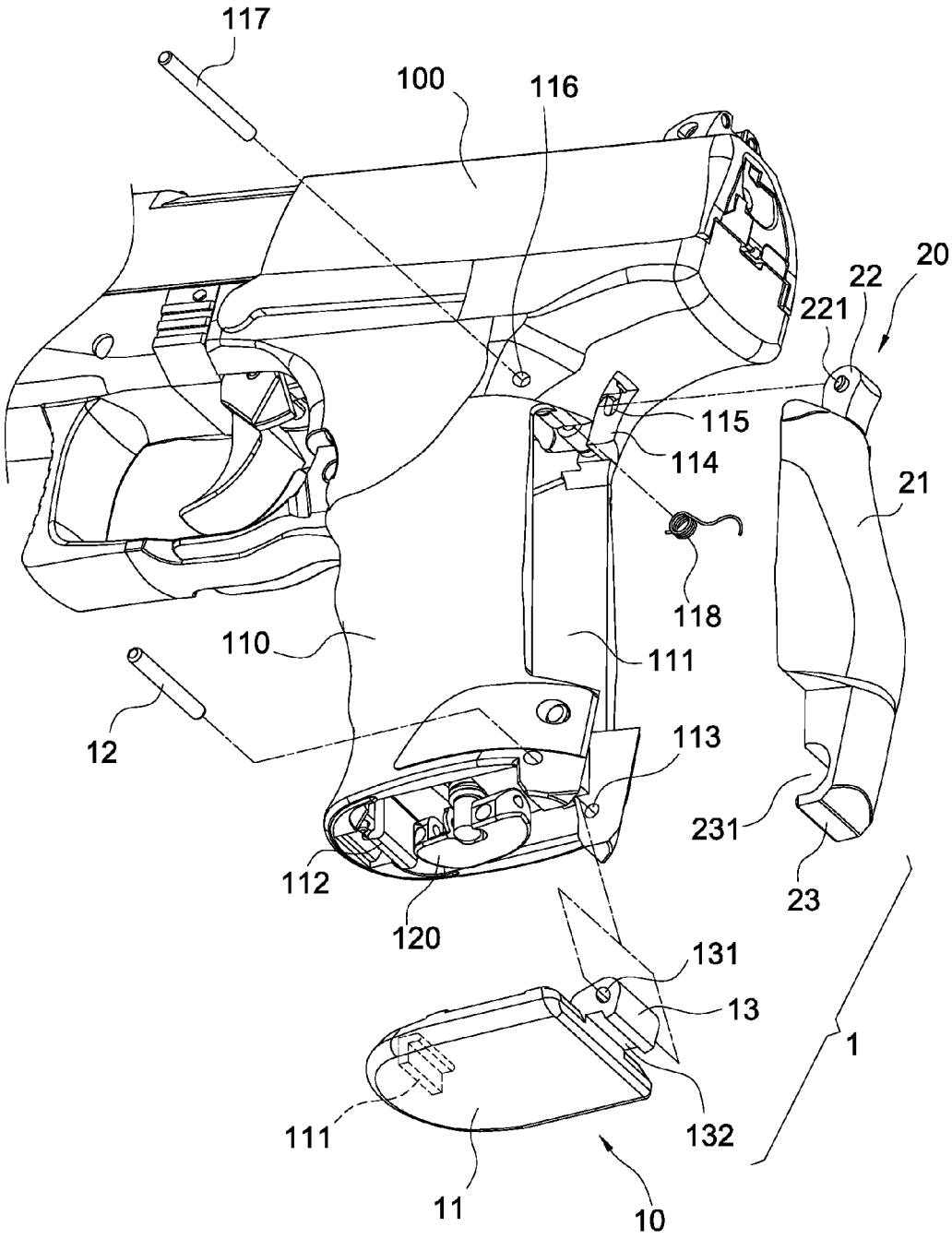
FIG. 1 is an exploded perspective of the present invention.

Please refer to FIG. 1, which is an exploded perspective view of the present invention. The present invention provides a structure for opening a grip cover of a toy gun. The structure 1 is mounted on a grip 110 of a toy gun 100. The structure 1 includes a bottom cover assembly 10 and a rear cover assembly 20. The bottom surface of the grip 110 is provided with a screw adjuster 120. The user can tighten or loosen the screw adjuster 120 to lift or lower a pressurized gas cylinder 130 in the grip 110. Since the rest portions (such as a trigger assembly, the screw adjuster 120, valves and lines for introducing gas, and a barrel) of the toy gun 100 belong to prior art and are not the characteristics of the present invention, the description thereof is omitted for clarity.

First, it should be noted that the directional terms used in this specification such as "front", "rear", "bottom" and "top" of the toy gun are determined by a normal state in which the user holds the toy gun with the grip facing downwards. Thus, the direction pointed by a muzzle of the barrel is referred to as the "front" direction, while the reverse direction is referred to as the "rear" direction. The direction pointed by the grip is referred to as the "downward" direction or the "bottom" of the toy gun, while the reverse direction is referred to as the "upward" direction or the "top" of the toy gun.

The grip 110 is provided at a rear section of the toy gun 100 and extends downwards. The grip 110 is substantially cylindrical and its profile conforms to human ergonomics, so that the grip 110 can be held by a user conveniently. A rear surface of the grip 110 has an opening 111 through which a pressurized gas cylinder 130 (FIG. 2) can be disposed in the grip 110. The rear cover assembly 20 covers the opening 111 and it can be opened rearwards with respect to the grip 110 to show the opening 111.

The bottom cover assembly 10 covers a bottom surface of the grip 110. The front end of the bottom surface of the grip 110 is provided with an engaging piece 112 to be engaged with a slot 111 provided on the bottom cover assembly 10. Further, both sides of the rear end of the bottom surface of the grip 110 are provided with a pivotal hole 113 respectively. The bottom cover assembly 10 is pivotally connected to the pivotal holes 110 and rotatable forwards or rearwards with respect to the grip 110.

The bottom cover assembly 10 has a bottom cover 11 covering the bottom surface of the grip 110, and a pivot 12 penetrating the grip 110 and the bottom cover 11. One end of the bottom cover 11 adjacent to the pivot 12 is formed with a first hook 13. The first hook 13 is provided with a pivotal hole 131 for allowing the pivot 12 to be inserted therein. With the pivot 12 penetrating the grip 110 and the pivotal hole 131 of the first hook 13, the bottom cover 11 can rotate rearwards or forwards with respect to the bottom surface of the grip 110. As viewed in FIG. 1, the counterclockwise (rearward) rotation of the bottom cover 11 makes it open with respect to the grip 110, while the clockwise (forward) rotation of the bottom cover 11 makes it closed with respect to the grip 110. When the user intends to open the bottom cover 11, the user only needs to lower the front edge of the bottom cover 11 until the slot 111 of the bottom cover 11 is separated from the engaging piece 112 of the grip 110. In this way, the bottom cover 11 can rotate counterclockwise freely to achieve an open state.

The rear cover assembly 20 has a rear cover 21 covering a rear surface of the grip 110. The upside of the rear cover 21 extends to form a pivoting portion 22. In the present embodiment, both sides of the pivoting portion 22 protrude to form a protrusion 221 respectively. The top of the rear surface of the grip 110 is formed with a notch 114. Inner walls on both sides of the notch 114 are provided with an insertion slot 115 respectively. The profile of the notch 114 and the positions of the insertion slots 115 on the inner walls of the notch 114 correspond to the profile of the pivoting portion 22 and the positions of the protrusions 221. With this arrangement, the pivoting portion 22 of the rear cover assembly 20 can be inserted into the notch 114 above the rear surface of the grip 110. Further, the rear cover 21 can rotate rearwards or forwards with respect to the grip 110 by using the protrusions 221 as a center of rotation, thereby opening or closing the opening 111 on the rear surface of the grip 110. As viewed in FIG. 1, the counterclockwise rotation of the rear cover 21 makes it open with respect to the grip 110, while the clockwise rotation of the rear cover 21 makes it closed.

Further, both sides of the upper portion of the grip 110 adjacent to the notch 114 are provided with a pivotal hole 116 respectively. A pin 117 penetrates the pivotal holes 116 and a restoring spring 118 in such a manner that the restoring spring 118 is arranged between the pivotal holes 116. One end of the restoring spring 118 abuts the inner wall of the grip 110, and the other end thereof abuts the inner wall of the rear cover 21. By the elastic force of the restoring spring 118, the rear cover 21 can be opened rearwards with respect to the grip 110 more rapidly.

In the rear cover assembly 20, one end of the rear cover 21 away from the pivoting portion 22 is formed with a second hook 23 to be engaged with the first hook 13 of the bottom cover assembly 10. As shown in FIG. 1, the first hook 13 is formed with a slot 132. The second hook 23 is bent toward the rear surface of the grip 110. A trough 231 is formed near the second hook 23. The profile of the trough 231 matches the profile of the first hook 13, and the second hook 231 can be inserted into the slot 132 of the first hook 13. With this arrangement, the first hook 13 and the second hook 23 can be engaged with each other.

Next, the principle of releasing the engagement between the first hook 13 of the bottom cover assembly 10 and the second hook 23 of the rear cover assembly 20 will be described. When the user lowers the front edge of the bottom cover 11 until the slot 111 inside the bottom cover 11 is separated from the engaging piece 112 on the bottom of the grip 110, the bottom cover 11 can rotate counterclockwise by using the pivot 12 as a center of rotation. Since the pivotal hole 131 of the first hook 13 is penetrated by the pivot 12, the first hook 13 can rotate counterclockwise together with the bottom cover 11. When the bottom cover 11 rotates counterclockwise to form an included angle of approximate 30 degrees with respect to the bottom surface of the grip 110, the second hook 23 of the rear cover assembly 20 will be separated from the slot 132 of the first hook 13, which causes the second hook 23 to start separating from the first hook 13. When the bottom cover 11 further rotates rearwards with respect to the grip 110, owing to the elastic force of the restoring spring 118, the rear cover assembly 10 will be opened rearwards with respect to the grip 110 by using the protrusions 221 as a center of rotation.

Figure 2:
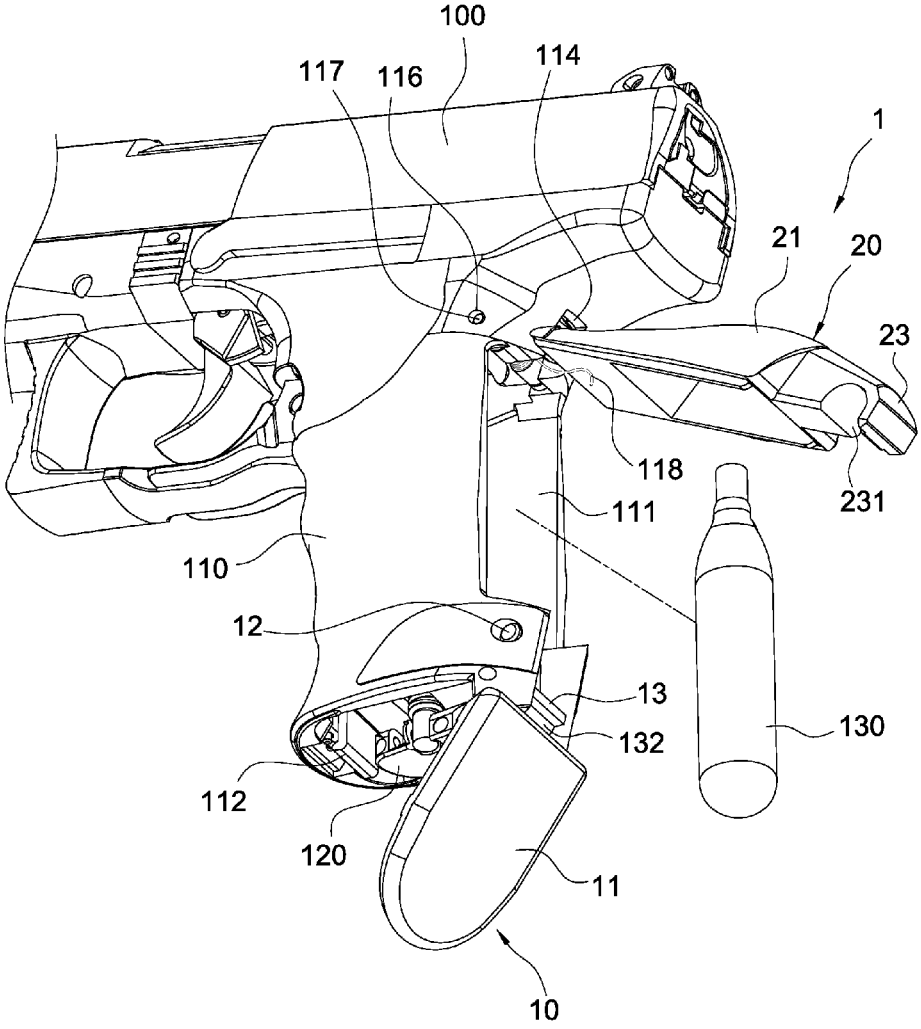
FIG. 2 is a schematic view showing that the present invention is open and a pressurized gas cylinder is to be installed in the grip.

Please refer to FIG. 2, which shows both the bottom cover assembly 10 and the rear cover assembly 20 of the present invention are opened. At this time, the user first loosens the screw adjuster 120 and takes the exhausted gas cylinder from the opening 111 on the rear surface of the grip 110. Then, the user installs a new gas cylinder 130 into the grip 110 through the opening 111. After the user tightens the screw adjuster 120, the new gas cylinder 130 can be lifted to connect to a valve (not shown).

Figure 3:
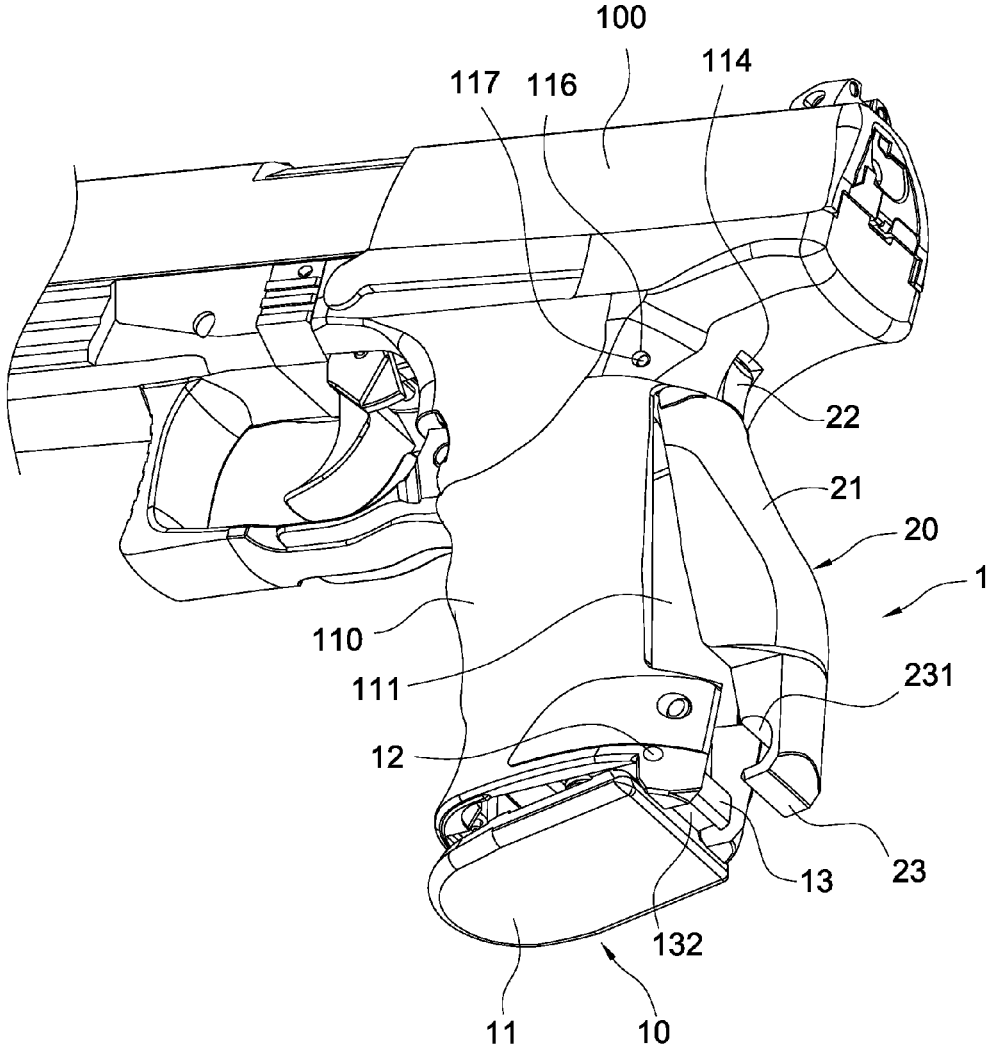
FIG. 3 is a schematic view showing that a pressurized gas cylinder is installed in the grip but the present invention is not closed.
Figure 5:
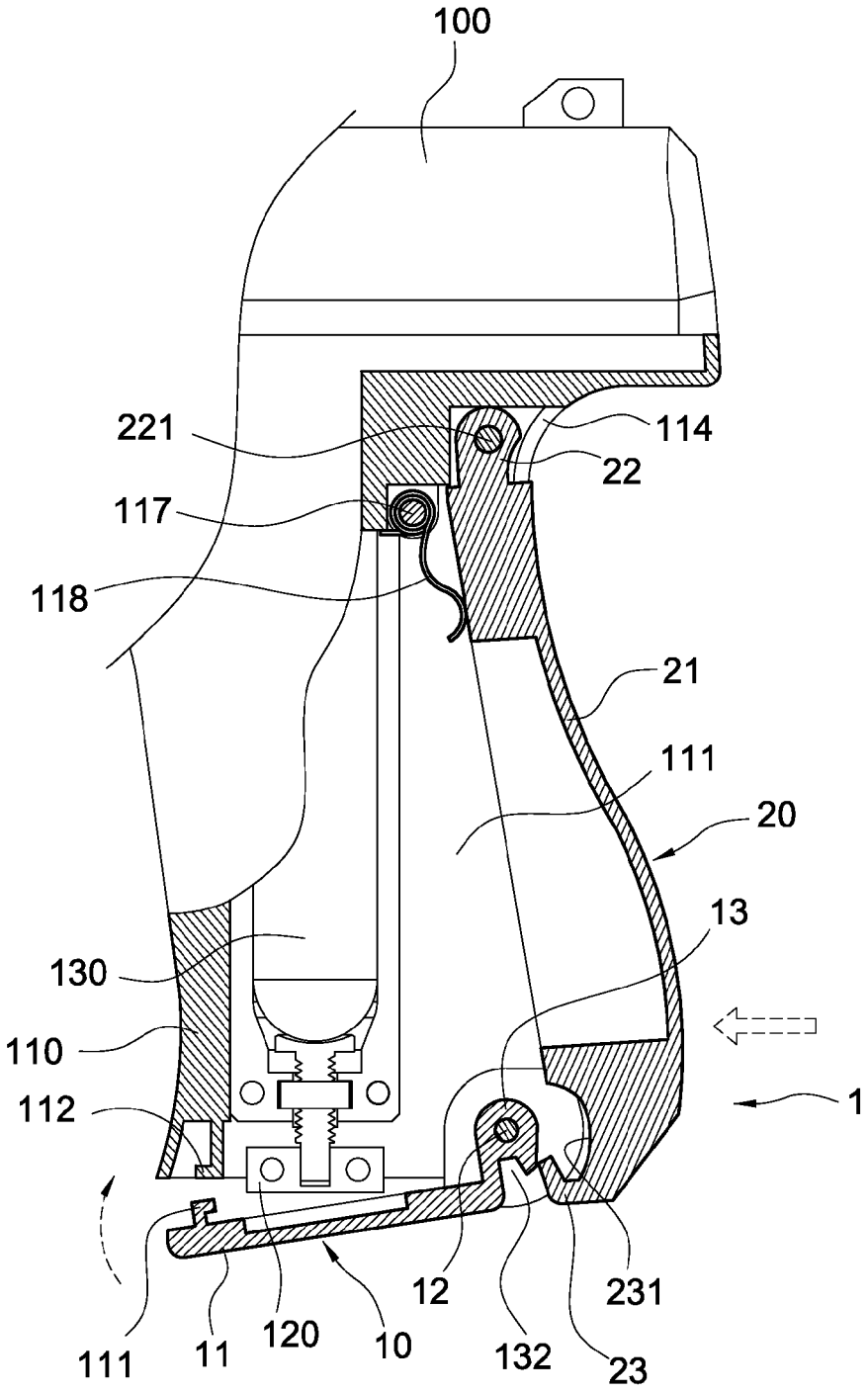
FIG. 5 is a partially cross-sectional view showing that a pressurized gas cylinder is installed in the grip but the present invention is not closed.

Please refer to FIGS. 3 and 5. After the new gas cylinder 130 is installed in the grip 110 and the user tightens the screw adjuster 120, the user first covers the bottom cover 11 on the bottom surface of the grip 110 (as shown in the dotted arrow on the left side of FIG. 5) until the slot 111 inside the bottom cover 11 is engaged with the engaging piece 112 of the grip 110 again.

Figure 4:
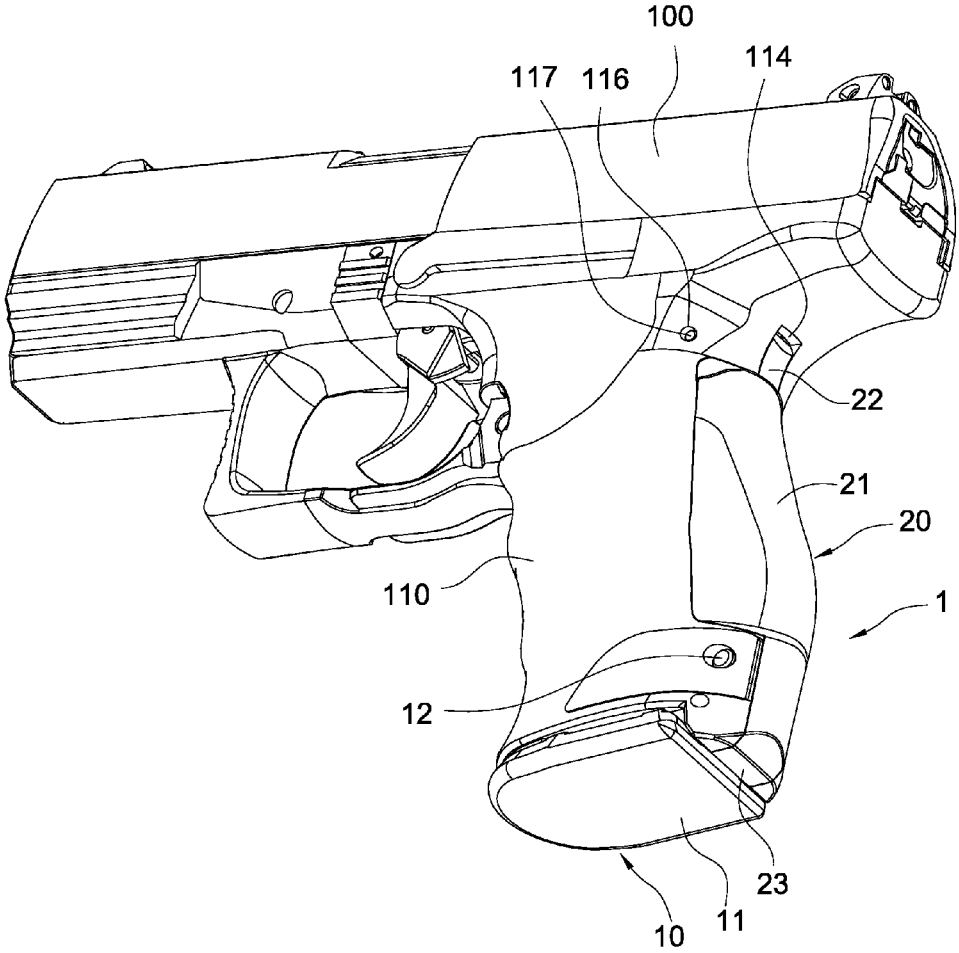
FIG. 4 is a schematic view showing that a pressurized gas cylinder is installed in the grip and the present invention is closed completely.
Figure 6:
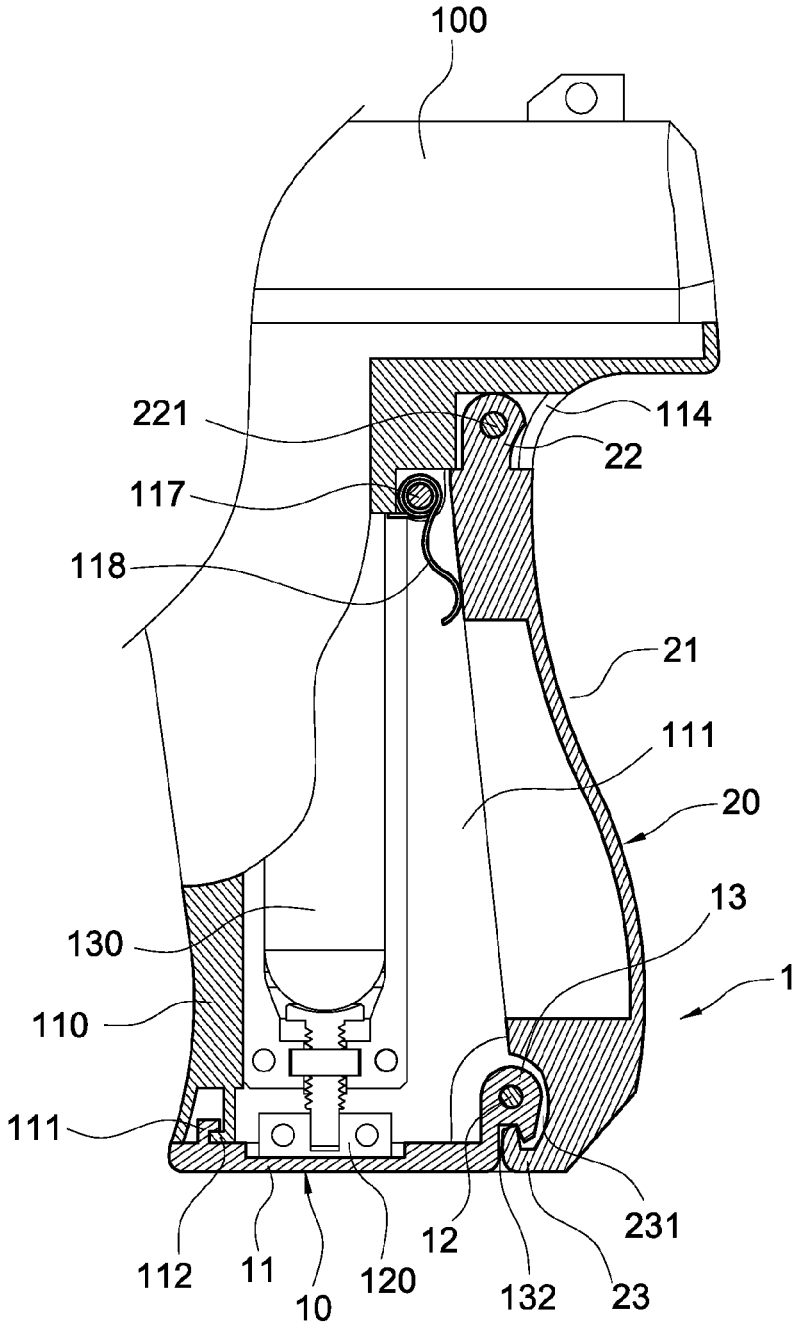
FIG. 6 is a partially cross-sectional view showing that a pressurized gas cylinder is installed in the grip and the present invention is closed completely.

Please refer to FIGS. 4, 5 and 6. The user first applies a force to overcome the elastic force of the restoring spring 118, thereby closing the rear cover assembly 20 on the opening 111 of the grip 110 (as indicated by the arrow on the left side of FIG. 5) until the second hook 23 is engaged with the first hook 13 of the bottom cover assembly 10 completely. Thus, the action of exchanging the pressurized gas cylinder 130 is finished.

In comparison with prior art, the present invention has advantageous features as follows.

When the bottom cover 11 of the bottom cover assembly 10 rotates downwards, the first hook 13 can be separated from the second hook 23 of the rear cover assembly 20, thereby driving the rear cover 21 to open rearwards by using the protrusions 221 as a center of rotation. Thus, by only opening the bottom cover 11 downwards, the user can simultaneously open the rear cover assembly 20 to show a pressurized gas cylinder 130 within the grip 110. In this way, the user can exchange the gas cylinder 130 easily and rapidly, so that the time for exchanging the gas cylinder 130 can be reduced.

In consideration of the fact that the screw adjuster 120 has to be loosened before the gas cylinder 130 is taken out of the grip 110, and the screw adjuster 120 has to be tightened after a new gas cylinder 130 is disposed in the grip 110, according to the present invention, the screw adjuster 120 in the bottom of the grip 110 can be shown when the bottom cover 11 is opened, and the gas cylinder 130 can be shown when the rear cover 21 is opened. Thus, according to the present invention, the user can open the bottom cover 11 easily to drive the rear cover assembly 20 to open simultaneously. Then, the user loosens the screw adjuster 120 to take the exhausted gas cylinder out of the grip 110, and installs a new gas cylinder 130 into the grip 110. Then, the user tightens the screw adjuster 120 and closes the bottom cover 11. Finally, the rear cover assembly 20 is closed on the rear surface of the grip 110 until the second hook 13 is engaged with the first hook 13. Therefore, it is apparent that the structure of the present invention can facilitate the operation of the user.

Further, since the bottom cover assembly 10 and the rear cover assembly 20 are pivotally connected to the grip 110 respectively, they will not be detached from the grip 110 to become two separate members. Thus, when exchanging the gas cylinder 130, the user needs not to worry that these two members may get lost or suffer damage.

Figure 7:
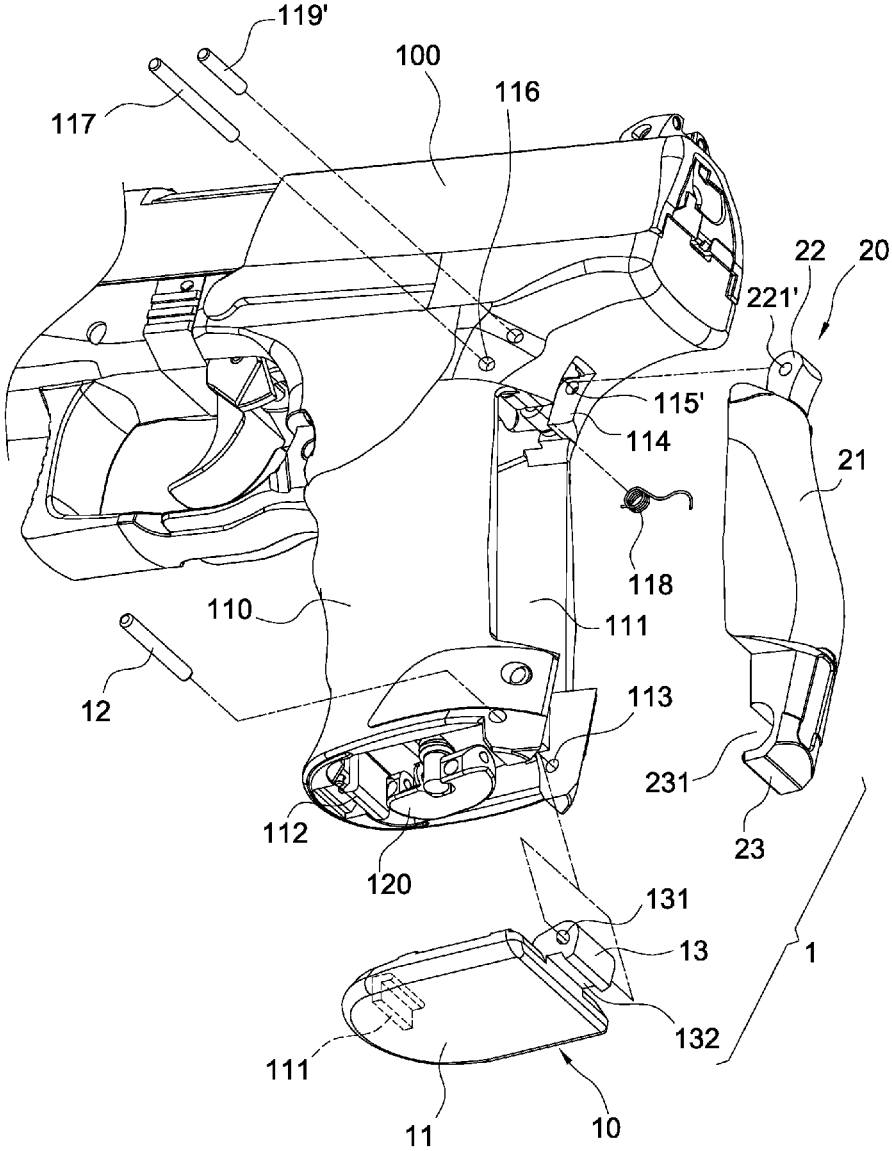
FIG. 7 is an exploded perspective view showing another embodiment of the present invention.

Although the structure 1 for opening a grip cover of a toy gun according to the present invention has been described with reference to the above-mentioned preferred embodiment, the structure 1 of the present invention is not limited thereto. For example, in the previous embodiment, both sides of the pivoting portion 22 of the rear cover assembly 20 are provided with a protrusion 221 respectively. The protrusions 221 can be inserted into the insertion slots 115 on the inner walls of the grip 110, thereby generating a pivotal connection. Alternatively, please refer of FIG. 7. The pivoting portion 22 can be modified as a through-hole 221', and the insertion slots 115 can be modified as pivoting holes 115' correspondingly. With another pin 119' penetrating the through-hole 221' and the pivoting holes 115', the effect of rotating the rear cover 21 rearwards or forwards with respect to the grip 110 can be also achieved.

According to above, the structure for opening a grip cover of a toy gun according to the present invention really solves the problems of prior art and demonstrates novelty and inventive steps. Thus, the present invention conforms to the requirements for an invention patent.

What is claimed is:

1. A structure for opening a grip cover of a toy gun, including:

a bottom cover assembly comprising a bottom cover covering a bottom surface of the grip and a pivot penetrating the grip and the bottom cover, the bottom cover being rotatable outwards with respect to the bottom surface of the grip, one end of the bottom cover adjacent to the pivot being formed with a first hook; and a rear cover assembly having a rear cover covering a rear surface of the grip, the rear cover having a protrusion connected to the grip, the rear cover being rotatable outwards with respect to the rear surface of the grip, one end of the rear cover away from the protrusion being formed with a second hook to be engaged with the first hook, wherein the first hook is separated from the second hook when the bottom cover rotates downwards, thereby driving the rear cover to open rearwards by using the protrusion as a center of rotation.

2. The structure for opening a grip cover of a toy gun according to claim 1, wherein one end of the rear cover has a pivoting portion, and the protrusion is formed on the pivoting portion.

3. The structure for opening a grip cover of a toy gun according to claim 2, wherein a notch is formed in a top of the rear surface of the grip for allowing the pivoting portion to be inserted therein, inner walls on both sides of the notch have an insertion slot respectively for allowing the protrusion to be inserted therein.

4. The structure for opening a grip cover of a toy gun according to claim 2, wherein the pivoting portion has a through-hole, and the protrusion penetrates the through-hole.

5. The structure for opening a grip cover of a toy gun according to claim 4, wherein a notch is formed in a top of the rear surface of the grip for allowing the pivoting portion to be inserted therein, outer walls on both sides of the notch have a pivotal hole respectively, the pivotal holes are aligned with the through-hole and penetrated by the protrusion.

6. The structure for opening a grip cover of a toy gun according to claim 1, further comprising a restoring spring disposed in the grip, both ends of the restoring spring abutting the grip and the rear cover respectively.

7. The structure for opening a grip cover of a toy gun according to claim 1, wherein the first hook has a pivotal hole for allowing the pivot to be inserted therein.

8. The structure for opening a grip cover of a toy gun according to claim 7, wherein the first hook has a slot for allowing the second hook to be inserted therein.

9. The structure for opening a grip cover of a toy gun according to claim 7, wherein the rear cover has a trough adjacent to the second hook, and the first hook is inserted into the trough.

10. A structure for opening a grip cover of a toy gun, including:

a bottom cover assembly comprising a bottom cover covering a bottom surface of the grip and a pivot penetrating the grip and the bottom cover, one end of the bottom cover adjacent to the pivot being formed with a first hook; and a rear cover assembly having a rear cover covering a rear surface of the grip, the rear cover having a protrusion connected to the grip, one end of the rear cover away from the protrusion being formed with a second hook to be engaged with the first hook, wherein the first hook is separated from the second hook when the bottom cover rotates downwards, thereby driving the rear cover to open rearwards by using the protrusion as a center of rotation.

11. The structure for opening a grip cover of a toy gun according to claim 10, wherein one end of the rear cover has a pivoting portion, and the protrusion is formed on the pivoting portion.

12. The structure for opening a grip cover of a toy gun according to claim 11, wherein a notch is formed in a top of the rear surface of the grip for allowing the pivoting portion to be inserted therein, inner walls on both sides of the notch have an insertion slot respectively for allowing the protrusion to be inserted therein.

13. The structure for opening a grip cover of a toy gun according to claim 11, wherein the pivoting portion has a through-hole, and the protrusion penetrates the through-hole.

14. The structure for opening a grip cover of a toy gun according to claim 13, wherein a notch is formed in a top of the rear surface of the grip for allowing the pivoting portion to be inserted therein, outer walls on both sides of the notch have a pivotal hole respectively, the pivotal holes are aligned with the through-hole and penetrated by the protrusion.

15. The structure for opening a grip cover of a toy gun according to claim 10, further comprising a restoring spring disposed in the grip, both ends of the restoring spring abutting the grip and the rear cover respectively.

16. The structure for opening a grip cover of a toy gun according to claim 10, wherein the first hook has a pivotal hole for allowing the pivot to be inserted therein.

17. The structure for opening a grip cover of a toy gun according to claim 16, wherein the first hook has a slot for allowing the second hook to be inserted therein.

18. The structure for opening a grip cover of a toy gun according to claim 16, wherein the rear cover has a trough adjacent to the second hook, and the first hook is inserted into the trough.

* * * * *